US009173493B1

(12) United States Patent
Fulton et al.

(10) Patent No.: US 9,173,493 B1
(45) Date of Patent: Nov. 3, 2015

(54) BLANKET WITH BUILT-IN BACKREST AND ACCESSORIES

(71) Applicants: Jason G. Fulton, Kirkland, WA (US); Douglas Hillius, Kirkland, WA (US)

(72) Inventors: Jason G. Fulton, Kirkland, WA (US); Douglas Hillius, Kirkland, WA (US)

( * ) Notice: Subject to any disclaimer, the term of this patent is extended or adjusted under 35 U.S.C. 154(b) by 0 days.

(21) Appl. No.: 14/564,689

(22) Filed: Dec. 9, 2014

Related U.S. Application Data

(60) Provisional application No. 62/005,427, filed on May 30, 2014.

(51) Int. Cl.

| | |
|---|---|
| ***A47C 1/14*** | (2006.01) |
| ***A47G 9/06*** | (2006.01) |
| ***A47C 7/66*** | (2006.01) |
| ***A47C 7/72*** | (2006.01) |
| *A47G 9/00* | (2006.01) |

(52) U.S. Cl.
CPC ... *A47C 1/14* (2013.01); *A47C 7/66* (2013.01); *A47C 7/72* (2013.01); *A47G 9/062* (2013.01); *A47G 2009/003* (2013.01); *A47G 2009/006* (2013.01)

(58) Field of Classification Search
CPC ..... A47C 1/14; A47C 1/146; A47C 4/54; A47C 7/66; A47C 7/72; A47C 7/725; A47C 16/00; A47C 21/003; A47C 27/08; A47C 27/081; A47C 27/10; A47C 29/00; A47C 29/003; A47G 9/0215; A47G 9/0223; A47G 9/06; A47G 9/062; A47G 9/08; A47G 9/083; A47G 9/086; A47G 9/1009; A47G 9/1027; A47G 9/1045; A47G 2009/003; A47G 9/006
USPC ..... 5/413 AM, 417–420
See application file for complete search history.

(56) References Cited

U.S. PATENT DOCUMENTS 4,681,195 A * 7/1987 Trahan et al. ..... 190/2
4,841,587 A * 6/1989 Carter et al. ..... 5/419

(Continued)

FOREIGN PATENT DOCUMENTS

CN 2233706 Y 9/1995
CN 2891867 Y 12/2005

(Continued)

OTHER PUBLICATIONS http://craziestgadgets.com/wp-content/uploads/2013/02/speaker-picnic-blanket.jpg (Feb. 21, 2013).

*Primary Examiner* — Nicholas Polito
(74) *Attorney, Agent, or Firm* — Robert C. Montgomery; Montgomery Patent & Design, LP

(57) ABSTRACT

An outdoor blanket having a water-resistant bottom layer, a cover layer, and an inflatable pneumatic chamber affixed to of the bottom layer. The pneumatic chamber has a nozzle for receiving air. The cover layer is affixed to the bottom layer and a there is a backrest having a shade assembly affixed to the cover layer. The shade assembly carries a solar panel. A collapsible support frame supports the backrest. The blanket also includes an insulated cooler having an interior cooler pocket, an interior first pocket, and an electrical system in electrical communication with the solar panel. The electrical system also includes a charging circuit for charging an internal battery. The collapsible support frame supports the backrest, the shade assembly, and the solar panel while the cover layer includes receivers for receiving bottom ends of the collapsible support frame. The cover layer also supports a cup holder.

26 Claims, 15 Drawing Sheets

(56) References Cited

U.S. PATENT DOCUMENTS

| | | | | |
|---|---|---|---|---|
| 4,989,600 | A * | 2/1991 | Collier | 607/95 |
| 5,116,288 | A * | 5/1992 | Kondo et al. | 2/171 |
| 5,226,184 | A * | 7/1993 | Cheng | 5/417 |
| 5,414,881 | A * | 5/1995 | Terrazas | 5/417 |
| 5,432,967 | A * | 7/1995 | Raftery | 5/633 |
| 6,668,407 | B1 * | 12/2003 | Reitzel | 5/656 |
| 7,225,483 | B1 * | 6/2007 | Remblad | 5/417 |
| 7,243,990 | B1 * | 7/2007 | Wahl | 297/184.15 |
| 7,444,705 | B2 * | 11/2008 | Chang | 5/713 |
| 8,002,349 | B1 * | 8/2011 | Pizzuto | 297/217.3 |
| D646,465 | S | 10/2011 | Marcial | |
| 8,485,596 | B1 * | 7/2013 | Martin | 297/184.14 |
| 8,549,680 | B1 * | 10/2013 | Nichols | 5/418 |
| 8,789,884 | B1 * | 7/2014 | Edelman et al. | 297/188.13 |
| 8,926,008 | B1 * | 1/2015 | Al-Hasan | 297/17 |
| 9,091,477 | B2 * | 7/2015 | Magnus | 1/1 |
| 9,101,222 | B2 * | 8/2015 | Minkoff et al. | 1/1 |
| 2005/0005355 | A1 * | 1/2005 | Marks et al. | 5/417 |
| 2007/0017027 | A1 * | 1/2007 | Bowman et al. | 5/417 |
| 2007/0113338 | A1 * | 5/2007 | Remblad | 5/420 |
| 2007/0283500 | A1 * | 12/2007 | Chang | 5/713 |
| 2011/0193372 | A1 * | 8/2011 | Pizzuto | 297/16.1 |
| 2012/0305414 | A1 * | 12/2012 | Magnus | 206/216 |
| 2013/0254999 | A1 * | 10/2013 | Foch | 5/639 |
| 2013/0256072 | A1 * | 10/2013 | Farhat | 190/2 |
| 2014/0097652 | A1 * | 4/2014 | Minkoff et al. | 297/180.14 |
| 2014/0292041 | A1 * | 10/2014 | Horowitz | 297/35 |

FOREIGN PATENT DOCUMENTS

| | | |
|---|---|---|
| CN | 201894436 U | 7/2011 |
| CN | 203059302 U | 2/2013 |

* cited by examiner

BLANKET WITH BUILT-IN BACKREST AND ACCESSORIES

RELATED APPLICATIONS

The present invention was first described in and claims the benefit of U.S. Provisional Application No. 62/005,427, filed on May 30, 2014, the entire disclosures of which are incorporated herein by reference.

FIELD OF THE INVENTION

The present invention relates to outdoor blankets. More particularly it relates to outdoor blankets having backrests, built-in coolers, and solar battery chargers.

BACKGROUND OF THE INVENTION

Very few leisure activities rival spending a warm summer day at a park, at a beach, at an outdoor concert, or at another outdoor location. When at such outdoor locations many people lie on large "outdoor" blankets. Such outdoor blankets provide insulation from the ground and help keep their users clean and comfortable.

One (1) serious drawback to outdoor blankets is that they do not enable a user to sit up. Should a user wish to eat, read, or just watch people while sitting up a chair must also be brought along. Chairs can be heavy, awkward, bulky and generally difficult to transport along with other items that are being taken, including the outdoor blanket. Another problem with outdoor blankets is that they do not provides storage locations for holding drinks or keeping them cold or for providing storage for music devices which thus must be carried separately. Thus a cooler might have to also be brought carried along with a music device. Yet another problem is that since outdoor blankets are usually used outdoors and well away from power outlets should electrical power be required while using an outdoor blanket electrical power might also need to be brought along. In the end a user simply may have to transport numerous items along with the outdoor blanket.

Accordingly, there exists a need for an outdoor blanket that provides back support to enable sitting up. Preferably such an outdoor blanket would also include a built in cooler and built in cup holders. Beneficially an outdoor blanket would also include a source of electrical power and a recharger for that electrical power source along with a storage pocket for holding items such as a glass wiping towel. Ideally such an outdoor blanket could be folded, stored and carried as a unit in a storage bag.

SUMMARY OF THE INVENTION

The principles of the present invention provide for outdoor blankets that provide back support to enable sitting up. The outdoor blanket also provides a built in cooler and a built in cup holder. Beneficially the outdoor blanket also includes a source of electrical power, a solar array for producing solar energy, and a charger for charging the source of electrical power. Also included is a storage pocket for a music player and items such as a glass wiping towel. That outdoor blanket can be folded, stored and carried as a unit in a storage bag.

A blanket that is in accord with the present invention includes a water-resistant bottom layer and an inflatable pneumatic chamber affixed to of the bottom layer, the pneumatic chamber having a nozzle for receiving air. A cover layer is affixed to the bottom layer and a backrest having a shade assembly which is affixed to the cover layer. A collapsible support frame supports the backrest. The shade assembly has a solar panel. The blanket also includes an interior insulated cooler, an interior first pocket, and an electrical system in electrical communication with the solar panel. The electrical system also includes a charging circuit for charging an internal battery. In use the collapsible support frame supports the backrest, the shade assembly, and the solar panel while the cover layer includes receivers for receiving bottom ends of the collapsible support frame.

The pneumatic chamber may included interconnected air containment cells and low volume nozzle having a retraction fold enabling the low volume nozzle to be folded into itself. In addition or in the alternative there may be a high volume nozzle located on the pneumatic chamber. The blanket may have a corner grommet, a cup holder extending from the cover layer, and/or an aperture passing through the blanket for receiving a pole.

The collapsible support frame might include a first vertical member having a first vertical upper end and a first diagonal frame member having a first diagonal lower end, a first diagonal upper end and a first spring-biased member disposed between the first diagonal lower end and the first diagonal upper end. A first flex joint then attaches the first vertical upper end to the first diagonal upper end. In addition there is a second vertical member having a second vertical upper end and a second diagonal frame member having a second diagonal lower end, a second diagonal upper end and a second spring-biased member disposed between second diagonal lower end and the second diagonal upper end. There is may also be a second spring-biased attachment for adjusting the relative position of the second diagonal frame member to the cover layer and a second flex joint attaching the second vertical upper end to the second diagonal upper end.

Alternatively, the collapsible support frame might include a first diagonal, a second diagonal and a fastener connecting the first diagonal to the second diagonal. The collapsible support frame then includes a first vertical having a first top tube, a first adjustment tube having a first bottom aperture, and a first fixed tube extending from the first top tube into the first adjustment tube. The first adjustment tube then includes a first button that mates with the first bottom aperture. Also included is a second vertical having a second top tube, a second adjustment tube having a second bottom aperture, and a second fixed tube extending from the second top tube and into the second adjustment tube. The second adjustment tube includes a second button that mates with the second bottom aperture. A first flex joint connects the first diagonal to the first top tube and a second flex joint connects the second diagonal to the second top tube.

The shade assembly may have a pair of mast tubes, a pair of carrier arms, and a pair of hinge brackets connecting a first end of an individual mast tube to a first end of an individual carrier arm. A bonnet spans between shade assembly carrier arms and at least one (1) shade attachment is affixed to the mast tube for mounting the shade to the collapsible frame.

The cooler may include an internal cooler pocket affixed to the cover layer and a lid having a closure affixed to the cover layer and disposed externally therefrom. An insulation layer is affixed to the interior surface of the cooler pocket and a moisture barrier is affixed within the insulation layer.

The blanket electrical system may include a conductor in electrical communication with the charging circuit and routed through the collapsible frame and a low voltage jack in electrical communication with the conductor. The charging circuit is in electrical communication with the solar panel. In addition, the blanket may include a speaker having an input connection configured to be in electrical communication with an external entertainment device and in which the speaker is in electrical communication with the conductor.

In addition there may be a carrying case having an open end, a closed end, a divider located within the case, and a retainer for selectively opening and closing the open end and such that the blanket fits within the carrying case.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
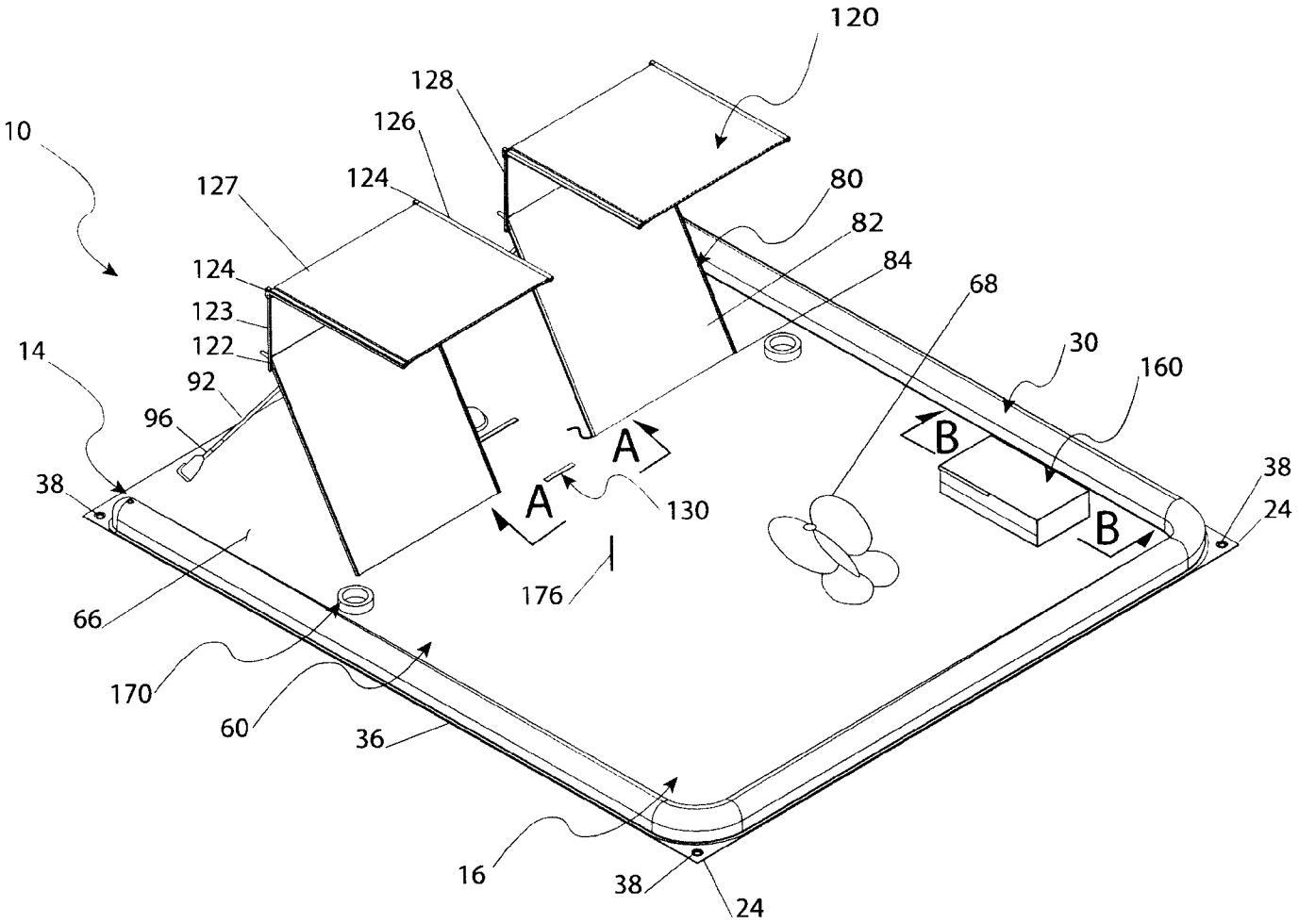
FIG. 1 is an isometric view of an outdoor blanket 10 that is in accord with the preferred embodiment of the present invention and which has backrests 80, a built-in cooler, a power source, a charger and other accessories.

10 blanket
14 head
16 foot
20 bottom layer
22 edge
24 corner
26 lower face
28 upper face
30 pneumatic chamber
32 bladder
34 seam
36 margin
38 grommet
40 low volume nozzle
44 retraction fold
46 stopper
50 high volume nozzle
52 neck
54 cap
60 cover layer
62 base weave
64 nap weave
66 top face
68 pattern
72 under face
74 roll
76 fold
78 stitching
80 backrest
82 flap
84 joint
86 channel
90 support frame
91 first diagonal
92 upper tube
93 spring tube
94 button
96 lower tube
97 button aperture
98 second diagonal
102 flex joint
104 first vertical
106 second vertical
112 tube receiver
114 rivet
120 shade
122 clip
123 mast tube
124 hinge bracket
125 carrier arm
126 bonnet
127 solar panel
128 conductor
130 main pocket
132 envelope
134 hemmed opening
136 wiper
140 speaker pocket
142 speaker
144 input jack
146 charging port
150 electrical system
153 battery
152 charging circuit
154 low-voltage power jack
155 battery input connector
160 cooler
161 cooler pocket
162 wall
163 lid
164 interior
165 overlap
166 insulation
167 moisture barrier
168 closure
170 cup holder
172 ring
176 stake aperture
180 carrying case
182 bag
184 divider
186 hem
188 retainer
200 alternate support frame
202 third vertical

204 top tube
206 adjustment tube
208 fixed tube
210 fourth vertical
212 adjustment aperture
214 third diagonal
216 fourth diagonal
218 pin fastener

DETAILED DESCRIPTION OF THE PREFERRED EMBODIMENT

Figure 13:
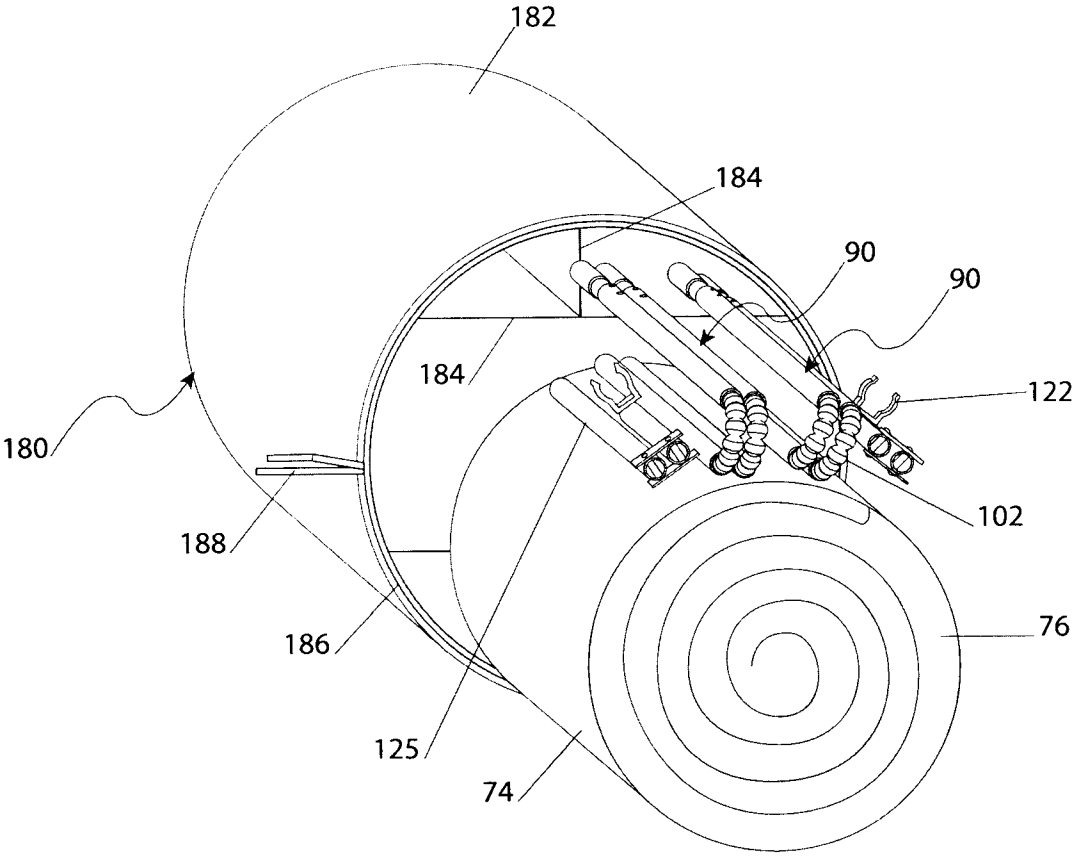
FIG. 13 is an isometric view of a carrying case 180 for the outdoor blanket 10.
Figure 14:
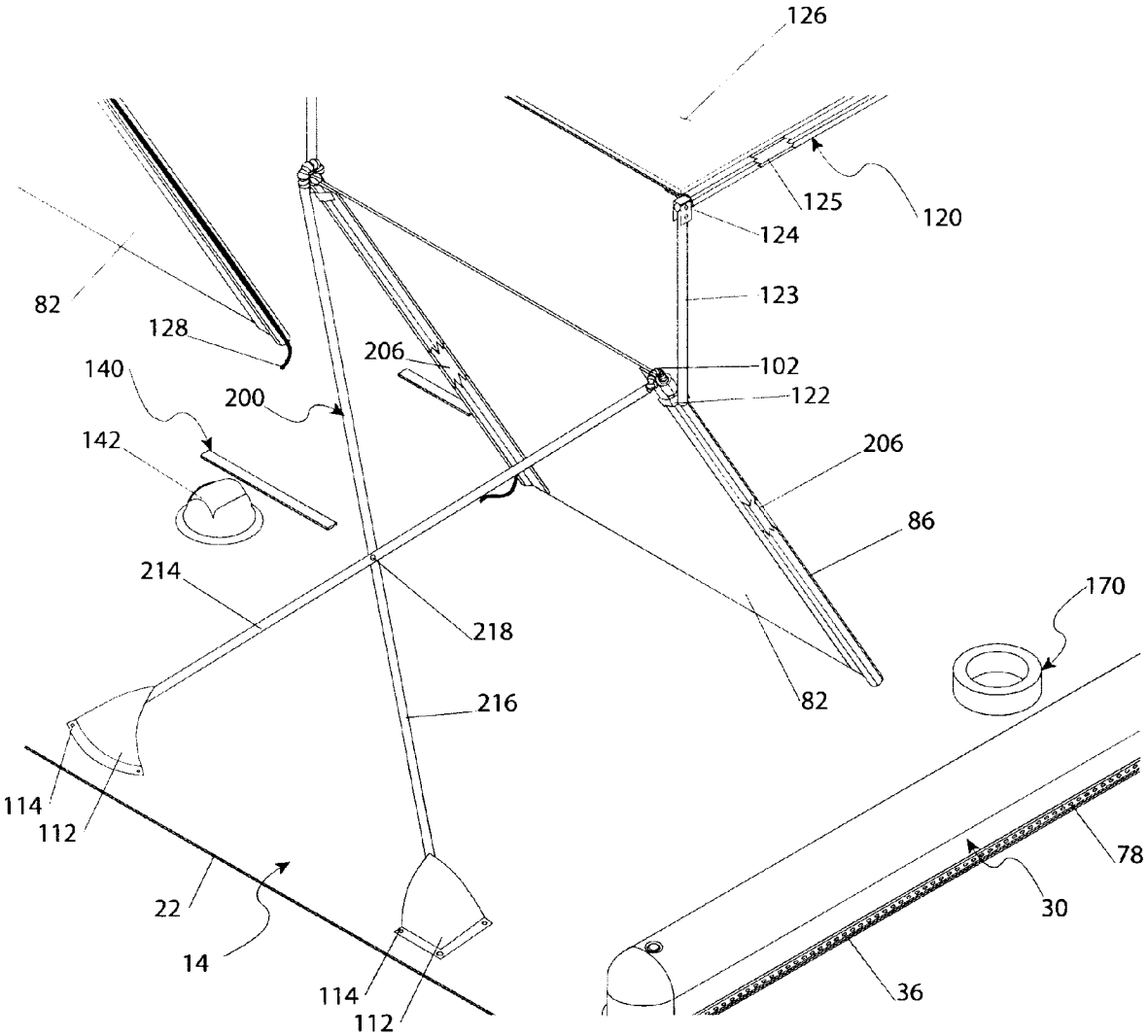
FIG. 14 is an isolated view of an alternate support frame 200 for the backrests 80; and, FIG. 15 is an isolated view of the alternate support frame 200 collapsed for storage.
Figure 15:
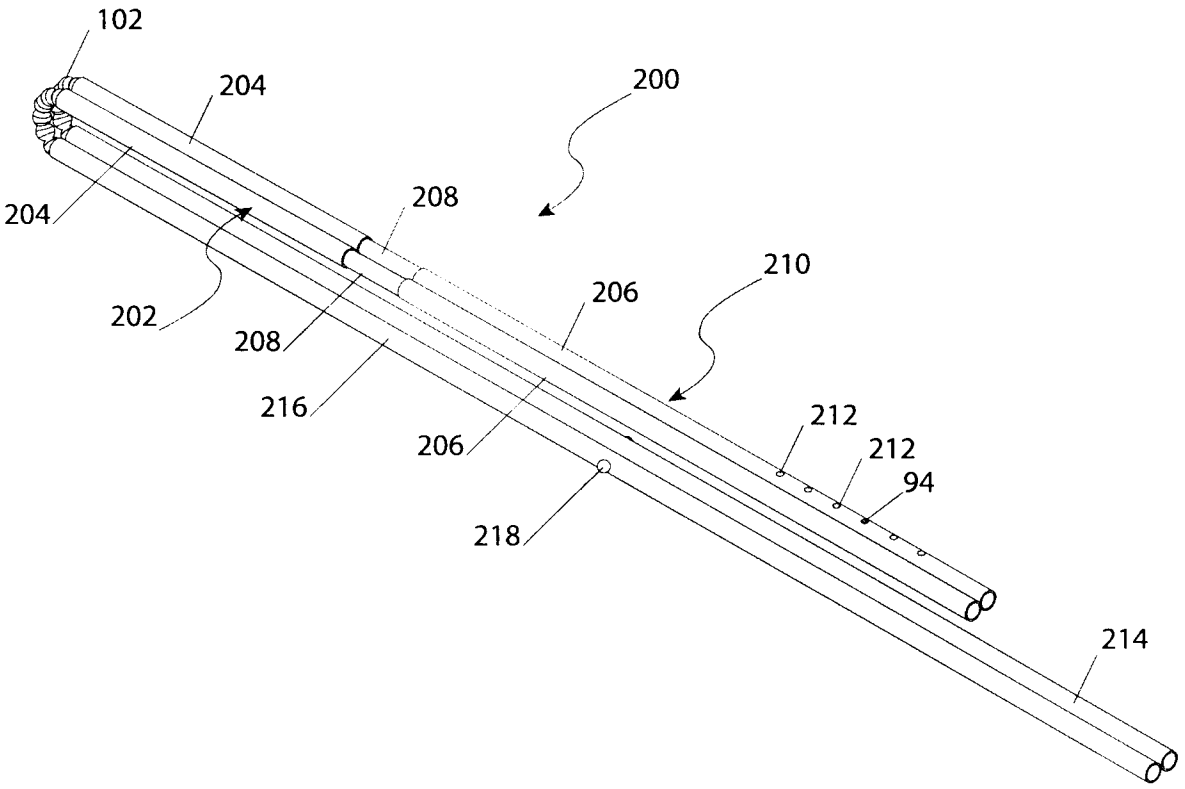

The preferred embodiment of the present invention is depicted in FIGS. 1 through 13 and an alternate embodiment is illustrated in FIGS. 14 and 15. However, the invention is not limited to the described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one of the referenced items. In addition, unless otherwise denoted all directional signals such as in, out, up, down, left, and right are taken with reference to FIG. 1.

Figure 2:
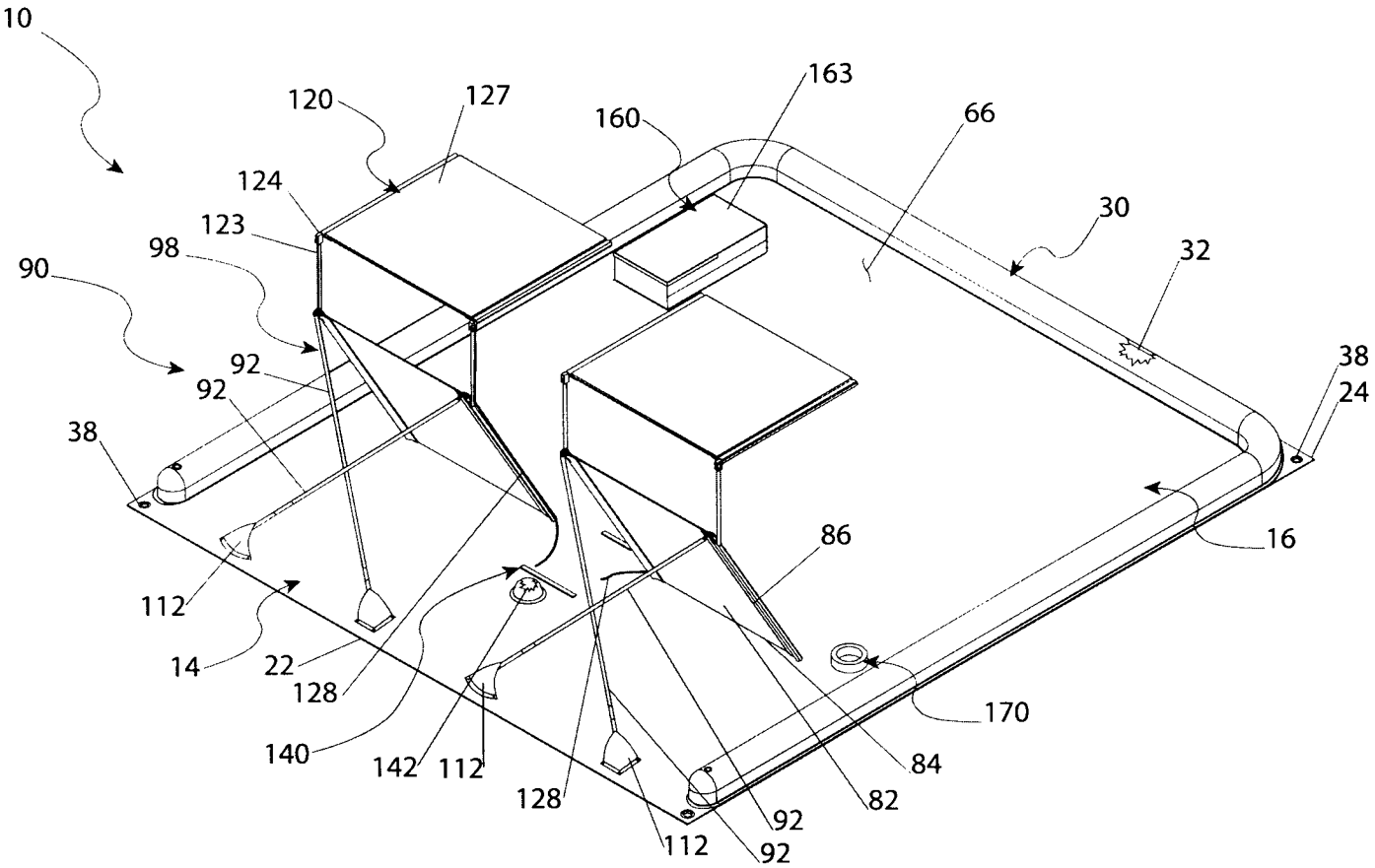
FIG. 2 is an isometric view from another angle of the outdoor blanket 10.

Refer now to FIGS. 1 and 2 for isometric views of an outdoor blanket 10 that is in accord with the preferred embodiment of the present invention. The outdoor blanket 10 includes at least one built-in backrest 80, various accessories as are subsequently described, and a water-resistant bottom layer 20 (shown in FIG. 3). The backrest 80 has an adjustable and removable support frame 90 as well as a flexible solar panel 127 that is incorporated into a collapsible shade 120. The outdoor blanket 10 further includes an insulated cooler 160 for temporary food storage, a main pocket 130 having an eyeglass wiper 136 (see FIG. 8), a compact speaker 142 with an audio input jack 144 in a speaker pocket 140 (also see FIGS. 6 and 10), and an inflatable pneumatic chamber 30 that runs along three (3) sides. The outdoor blanket 10 is collapsible and foldable for insertion into a carrying case 180 (see FIG. 13) for transportation or storage.

Figure 3:
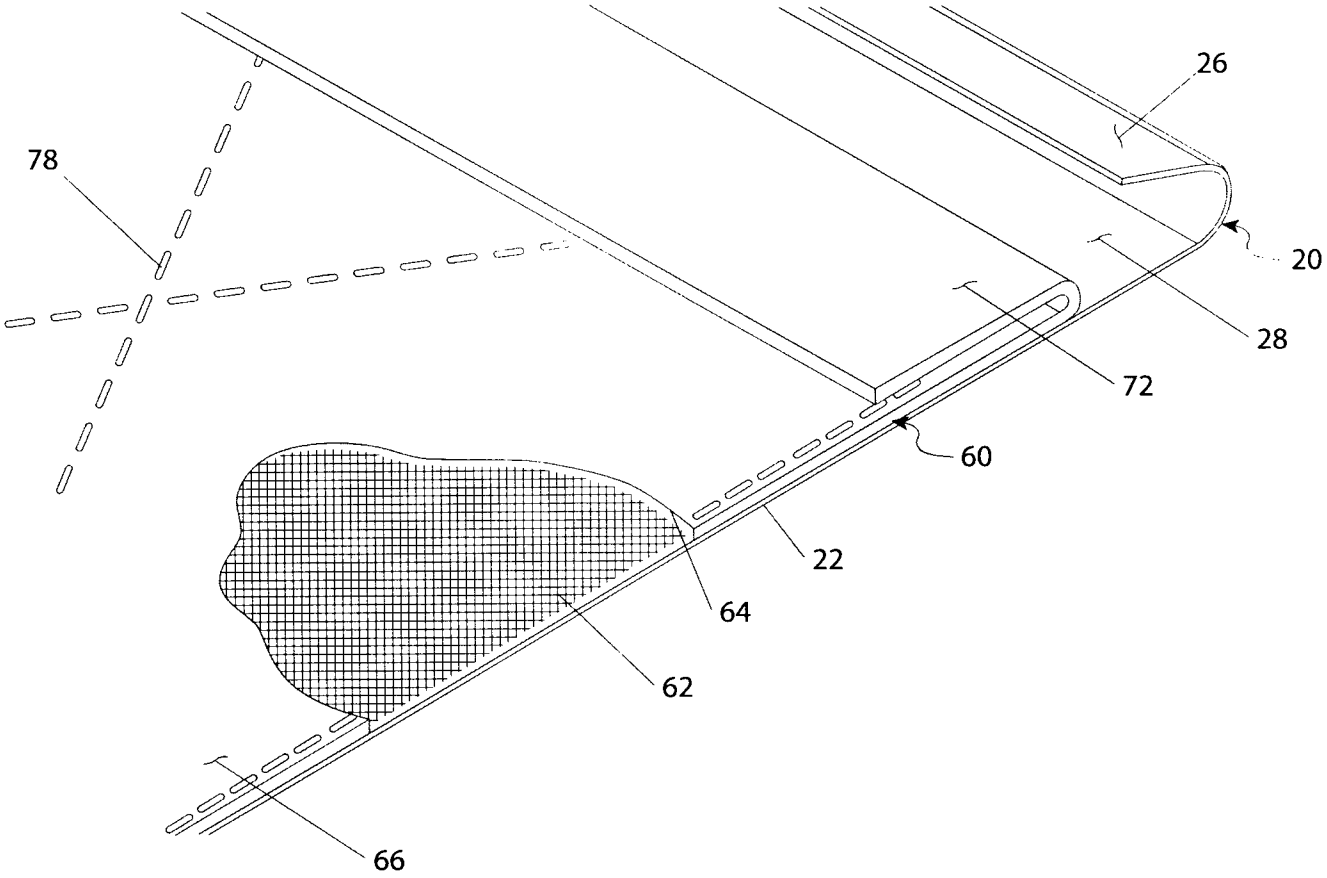
FIG. 3 is an isolated view of a bottom layer 20 and a cover layer 60 used in the outdoor blanket 10.

That area of the outdoor blanket 10 with the backrests 80 will hereafter be referred to as the head 14, whereas the opposite end will be referred to as the foot 16. Referring now to FIG. 3, the outdoor blanket 10 includes a weather resistant bottom layer 20 that is attached to a cover layer 60 by stitching 78. The bottom layer 20 is preferably composed of a thermoplastic sheet which is bonded to a core layer made of a reinforcing mesh of a high strength fiber such as nylon. The bottom layer 20 has a lower face 26 for contacting the ground or other support surface and an upper face 28 in contact with the cover layer 60.

Figure 4:
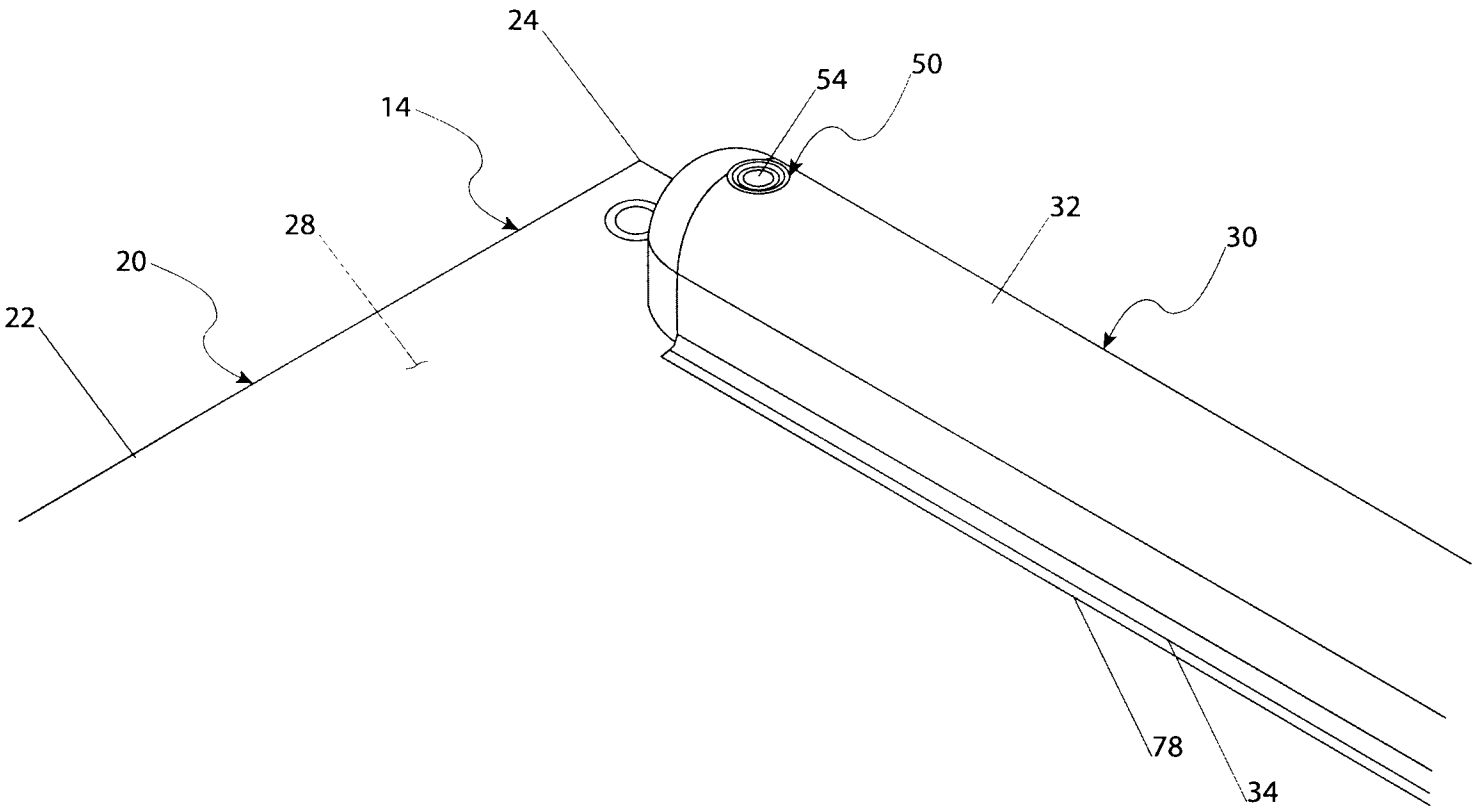
FIG. 4 is an isolated view of a pneumatic chamber 30 sealed to the bottom layer 20 of the outdoor blanket 10.

Referring now primarily to FIGS. 1, 2, and 4, a pneumatic chamber 30 having a plurality of interconnected air containment cells is fixed to the upper face 28 along three lateral edges 22 that run along the foot 16. The pneumatic chamber 30 forms an obstacle to egress of items from the outdoor blanket 10. The pneumatic chamber 30 is preferably comprised of one (1) or more pieces of a tough, resilient thermoplastic material such as a high-density polyethylene which is formed into a "U"-shaped bladder 32 and then sealed along seams 34. The constituent material of the bladder 32 may be augmented with other thermoplastic formulations as necessary to fortify the seal along the seam(s) 34.

At least one (1) seam 34 runs along the pneumatic chamber 30 on the interior side of its "U" shape. A margin 36 (see FIG. 1) is provided on the outside of the "U" shape for attaching the pneumatic chamber 30 by a heat seal to the bottom layer 20. Note that the cover layer 60 is not shown in FIG. 4 so that specific features can be shown. Additional margins 36 can run along the distal side of the pneumatic chamber 30 for heat attachment of corners 24 of the bottom layer 20 and/or for attachment of the cover layer 60. The cover layer 60 is configured to lie over the bladder 32 with attachment to the bottom layer 20 by stitching 78. The quantity of air in the bladder 32 determines the pressure in the pneumatic chamber 30 and therefore the extent to which the pneumatic chamber 30 presents a barrier.

Figure 5B:
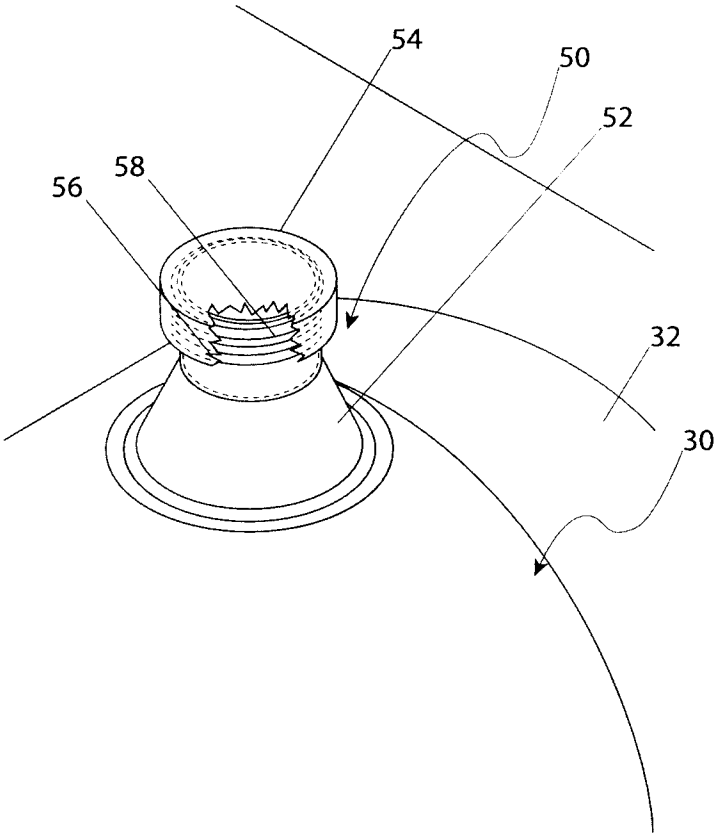
FIG. 5*b* is an enlarged isolated, view of a high volume nozzle 50 which is attached to the pneumatic chamber 30.
Figure 5A:
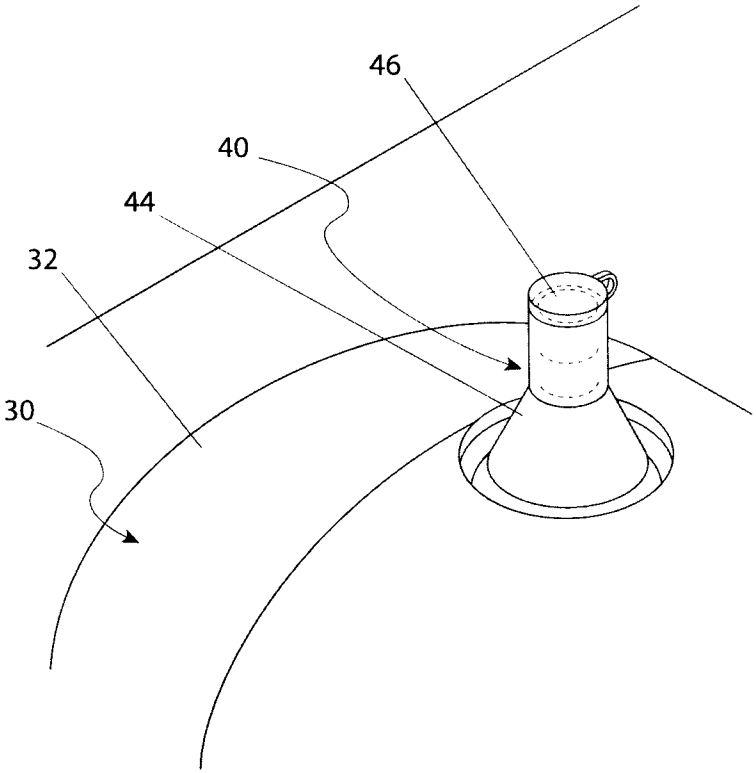
FIG. 5*a* is an enlarged, isolated view of a low volume nozzle 40 which is attached to the pneumatic chamber 30.

As shown in FIGS. 4 and 5*a* and 5*b* the pneumatic chamber 30 is provided with a low volume nozzle 40 on an end of the bladder 32. Air may be introduced into or evacuated from the pneumatic chamber 30 using that low volume nozzle 40. Again note that the cover layer 60 is not shown in FIGS. 4 and 5*a* and 5*b* to reveal features underneath the cover layer 60. The low volume nozzle 40 is equipped with a stopper 46 which blocks the flow of air into and out of the pneumatic chamber 30. The stopper 46 is beneficially either a plug that is inserted into the flow channel of the low volume nozzle 40 or a cap installed on the exterior of the low flow nozzle 40. The low volume nozzle 40 may also include a check valve or similar flow restriction device having a secondary release mechanism which the user would actuate to release air from the pneumatic chamber 30. The low volume nozzle 40 preferably includes a retraction fold 44 which enables the low volume nozzle 40 to fold into itself and into the pneumatic chamber 30 so as not to project outward.

The pneumatic chamber 30 also has a high volume nozzle 50 at an end of the bladder 32, reference FIG. 5*b*. The high volume nozzle 50 has a larger cross-section than the low volume nozzle 40 and therefore capable of permitting a higher air flow with an equal differential air pressure. The high volume nozzle 50 has a neck 52 which serves as an air flow channel and a cap 54 that forms a seal. The neck has external threads 58 for retaining the cap 54 which is provided with complementary and engaging internal threads 56. It is envisioned that the neck 52 will permit a properly inserted cap 54 to be folded into the neck 52 and into the pneumatic chamber 30 in a manner similar to the low volume nozzle 40.

Returning to FIG. 3, the cover layer 60 is preferably a woven textile consisting of an open base weave 62 with a set of synthetic fibers forming a carrier mat and a nap weave 64 that are configured to fill the interstitial spaces of the base weave 62 with a high pile, multi-fiber material. The pile may be uniformly cut or sculpted to suit the taste of a user. The cover layer 60 has an under face 72 in contact with the upper face 28 of the bottom layer 20 and a top face 66. The top face 66 may be provided in a wide variety of colors and may include a design or pattern 68 as may suit a user.

As previously stated, the cover layer 60 is attached to the bottom layer 20 preferably by sewing the two (2) layers 20, 60 together with stitching 78 such as a spun nylon thread or the like. The layers 20, 60 would minimally be attached around the perimeter of the outdoor blanket 10 and may involve folding the raw edges 22 internally to prevent unraveling of materials. Stitching 78 in other portions of the outdoor blanket 10 may be performed in a square grid pattern or in any other geometric fashion which would adequately secure the cover layer 60 to the bottom layer 20. The bottom layer 20 may be coated with other solutions or materials in order to waterproof the stitching 78 and restore the integrity of the bottom layer 20.

Turning back to FIGS. 1 and 2, disposed in each corner 24 of the outdoor blanket 10 is a grommet 38. The grommets 38 can be used to implement stabilization of the outdoor blanket 10 by using items such as stakes. The grommets 38 are preferably metal and are inserted through aligned apertures in both the bottom layer 20 and in the cover layer 60.

Figure 11:
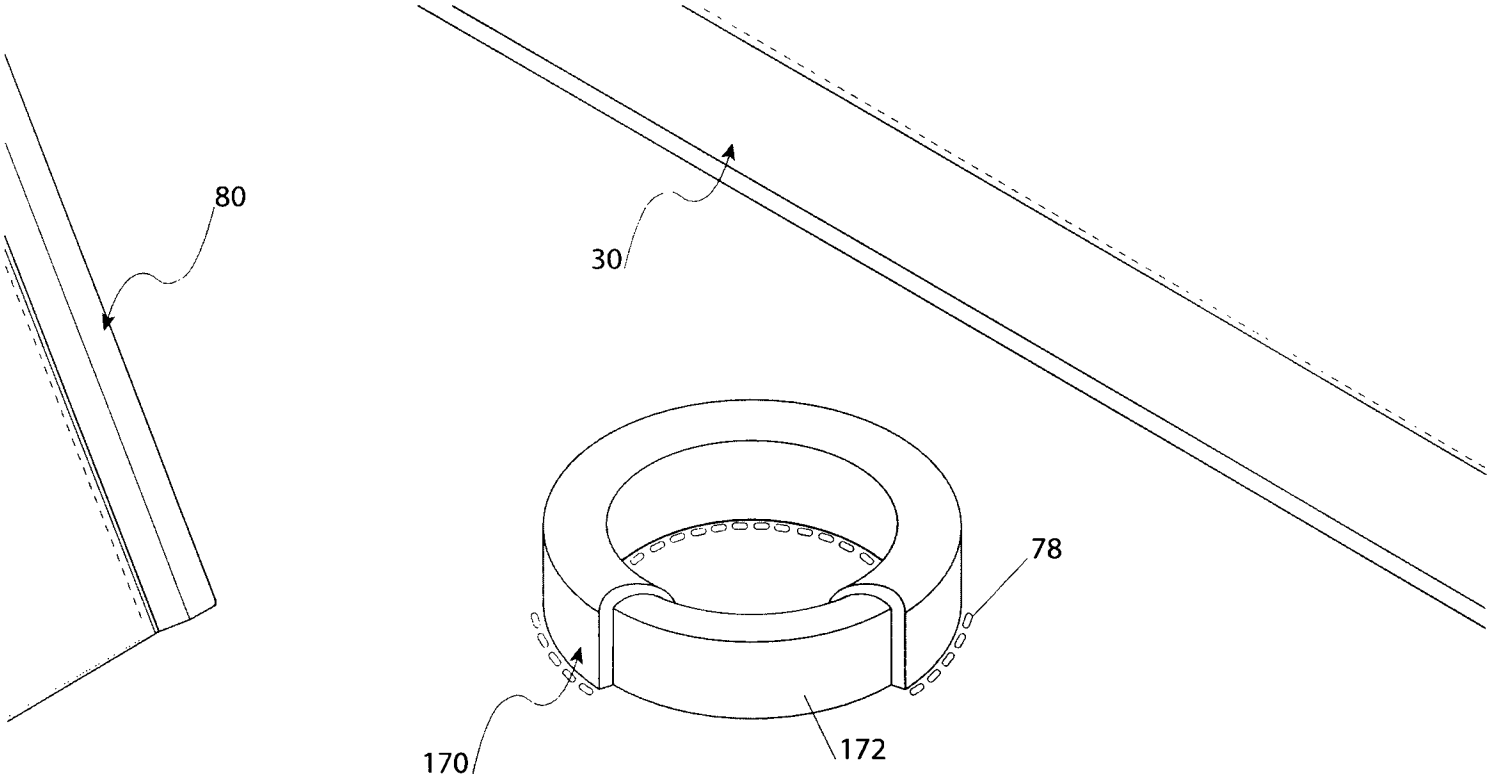
FIG. 11 is an isolated, cutaway view of a cup holder 170 of the outdoor blanket 10.

Referring now to FIG. 1, 2, 6 and predominately 11, at least one (1) cup holder 170 is located on the cover layer 60 near a backrest 80. The cup holder 170 is beneficially configured as a ring 172 that is secured between the cover layer 60 and the bottom layer 20 as shown in FIG. 11. The ring 172 is an annular ring made from any of a variety of thermoplastic materials and has an inside diameter that is sufficient to accommodate a twelve ounce (12 oz.) beverage container. It should be understood that other materials, such as metal, wood, or wood by-products, may be utilized without limiting the scope of the outdoor blanket 10. The cup holder 170 also may also have stitching 78 around the inside and outside diameter of the ring 172 to stabilize and define the cup holder 170.

Referring to FIG. 1, located at about the middle of the outdoor blanket 10 is a stake aperture 176. The stake aperture 176 has a hemmed opening through both the cover layer 60 and the bottom layer 20. The stake aperture 176 is hemmed to preferentially keep the opening concealed. Material as required may be added to fashion an overlapping hem. The stake aperture 176 is used to erect a sun-shading umbrella when conditions allow such a device to be used, such as in sandy soil at a beach location.

Figure 6:
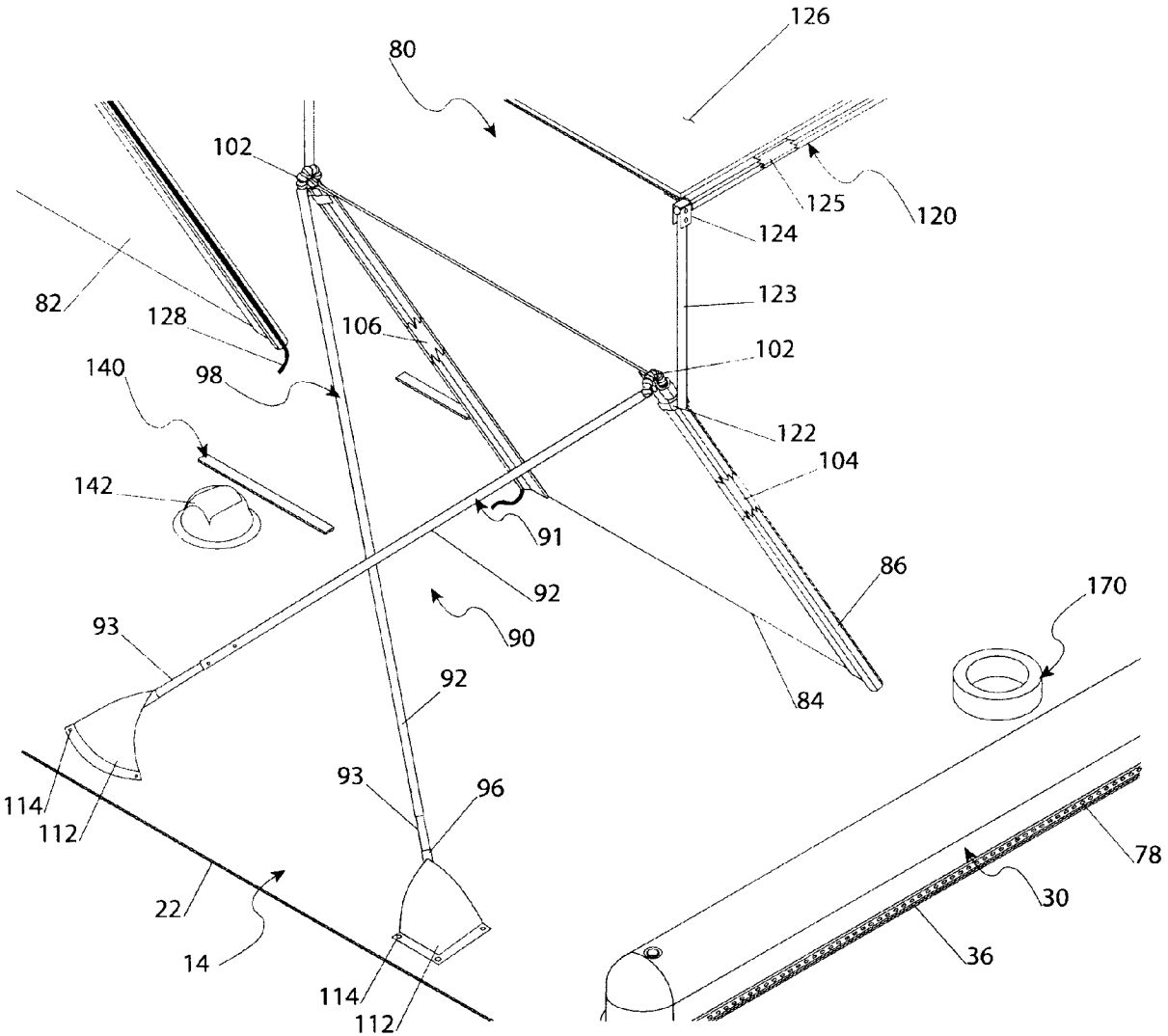
FIG. 6 is an isolated view of a support frame 90 for the backrests 80 of the outdoor blanket 10.
Figure 7:
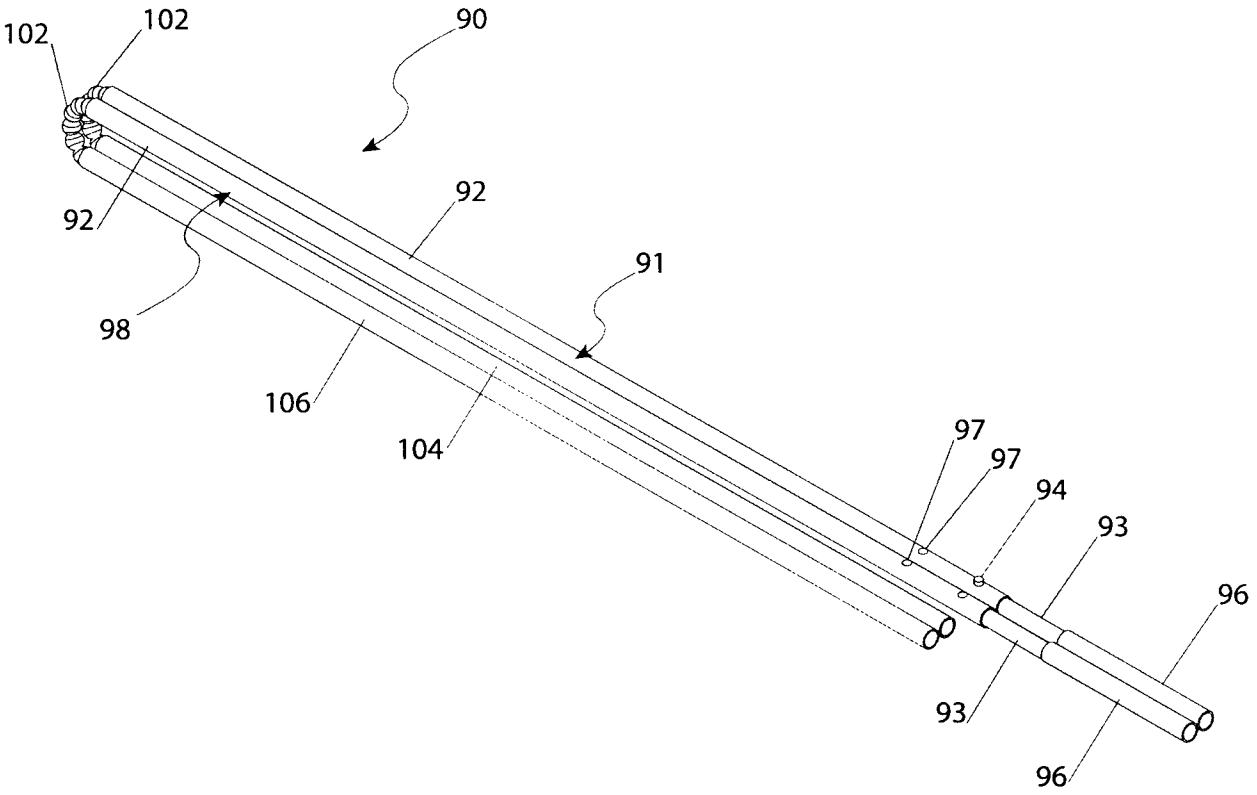
FIG. 7 is an isolated view of the support frame 90 collapsed for storage.

Refer now to FIG. 2 and to FIG. 6 for isolated views of a support frame 90 for the backrest 80, and to FIG. 7 for an isolated view of the support frame 90 when collapsed for storage. FIG. 6 also shows a breakaway view of a speaker pocket 140. Each backrest 80 includes a lower flap 82 of material similar to the cover layer 60 and which is attached to the cover layer 60 along a joint 84. The joint 84 may be reinforced with metal fasteners, such as rivets, or the like, and may involve an attachment to the bottom layer 20 as well. The flap 82 is of a sufficient width to span the width of the upper torso of an adult.

Disposed on each lateral edge of the flap 82 is a hemmed channel 86 that is capable of accommodating the insertion of a first or a second vertical member 104, 106 respectively, of the support frame 90. The support frame 90 is preferably composed of round aluminum tubing. The support frame 90 also includes a first diagonal 91 having an upper tube 92, a spring tube 93, and a lower tube 96. The spring tube 93 is configured to fit inside of and be permanently attached to the lower tube 96. The spring tube 93 also fits inside the upper tube 92. However, a relative sliding motion between the spring tube 93 and the upper tube 92 can occur under certain circumstances thereby governing the overall length of the first diagonal 91. Disposed inside an upper end of the spring tube 93 is a spring-biased button 94. The button 94 projects through an aperture in the upper end of the spring tube 93. Disposed in the lower end of the upper tube 92 are at least two (2) button apertures 97. The projection of the button 94 through an aperture of the spring tube 93 is sufficient to become engaged within one (1) of the button apertures 97.

The shortest length of the first diagonal 91 occurs when the button 94 is engaged in the top-most button aperture 97 and the lower end of the upper tube 92 abuts the upper end of the lower tube 96. In this arrangement the backrest 80 is maintained at the lowest angle of repose and the user can recline at the most recumbent position. The longest length of the first diagonal 91 occurs when the button 94 is engaged in the lower-most button aperture 97 and the backrest 80 is then secured in the steepest angle of repose. The second diagonal 98 is fabricated in a similar manner to the first diagonal 91 with a lower tube 96, a spring tube 93, and an upper tube 92. The first diagonal 91 is attached at an upper end to a first vertical 104 through a flex joint 102. The second diagonal 98 is attached to a second vertical 106 through a similar flex joint 102.

Each flex joint 102 is configured to be a metallic, segmented, semi-flexible connection capable of transferring loads from the vertical tubes 104, 106 to the diagonal tubes 91, and 98 respectively by an interconnection of the segments with each other after reaching the limit of their relative motion. The lower ends of the first diagonal 91 and the second diagonal 98 are stabilized in tube receivers 112 that are located on the top face 66 of the cover layer 60. The tube receivers 112 are preferably configured to be generally triangular shaped pieces of material made of the same constituent material as the cover layer 60 and stitched to the cover layer 60. It is understood that other materials, such as canvas or leather, may be utilized without limiting the scope of the outdoor blanket 10.

The base of the triangular tube receivers 112 are stitched in an "L"-shape pattern with a leg of the "L" parallel to the joint 84 of the flap 82, and the other perpendicular leg going toward the flap 82. The two (2) tube receivers 112 for each support frame 90 are generally mirror images of each other and spaced at a distance approximately equal to the width of the flap 82. The attachment of the tube receivers 112 to the cover layer 60 is fortified with the insertion of a plurality of rivets 114 and may involve a common attachment to the bottom layer 20. The support frame 90 may be collapsed as shown in FIG. 7 for insertion into a carrying case 180 for transportation or for storage (see FIG. 13).

Still referring to FIGS. 2 and 6, the detachable shade 120 is connected to each of the support frames 90 of the backrests 80 by spring clips 122 which are engaged around the first verticals 91 and the second verticals 98. The clips 122 are configured to partially encircle an upper end of the first vertical 91 and of the second vertical 98 and to be retained by a constricting clamping force to the clips 122. The clips 122 are connected to a lower end of a mast tube 123 by a headed pin. The mast tubes 123 are preferably round aluminum tubes similar to the support frame 90. A hinge bracket 124 is connected at an upper end of each mast tube 123 along with a tubular carrier arm 125. The carrier arms 125 extend outwardly over the backrests 80 and a bonnet 126 (see FIG. 6) is attached thereto. The bonnet 126 is configured to be similar to the flap 82 of the backrest 80 and made of substantially the same material and having the hemmed channels 86 that are capable of accommodating the insertion of the carrier arms 125 for support.

Figure 12:
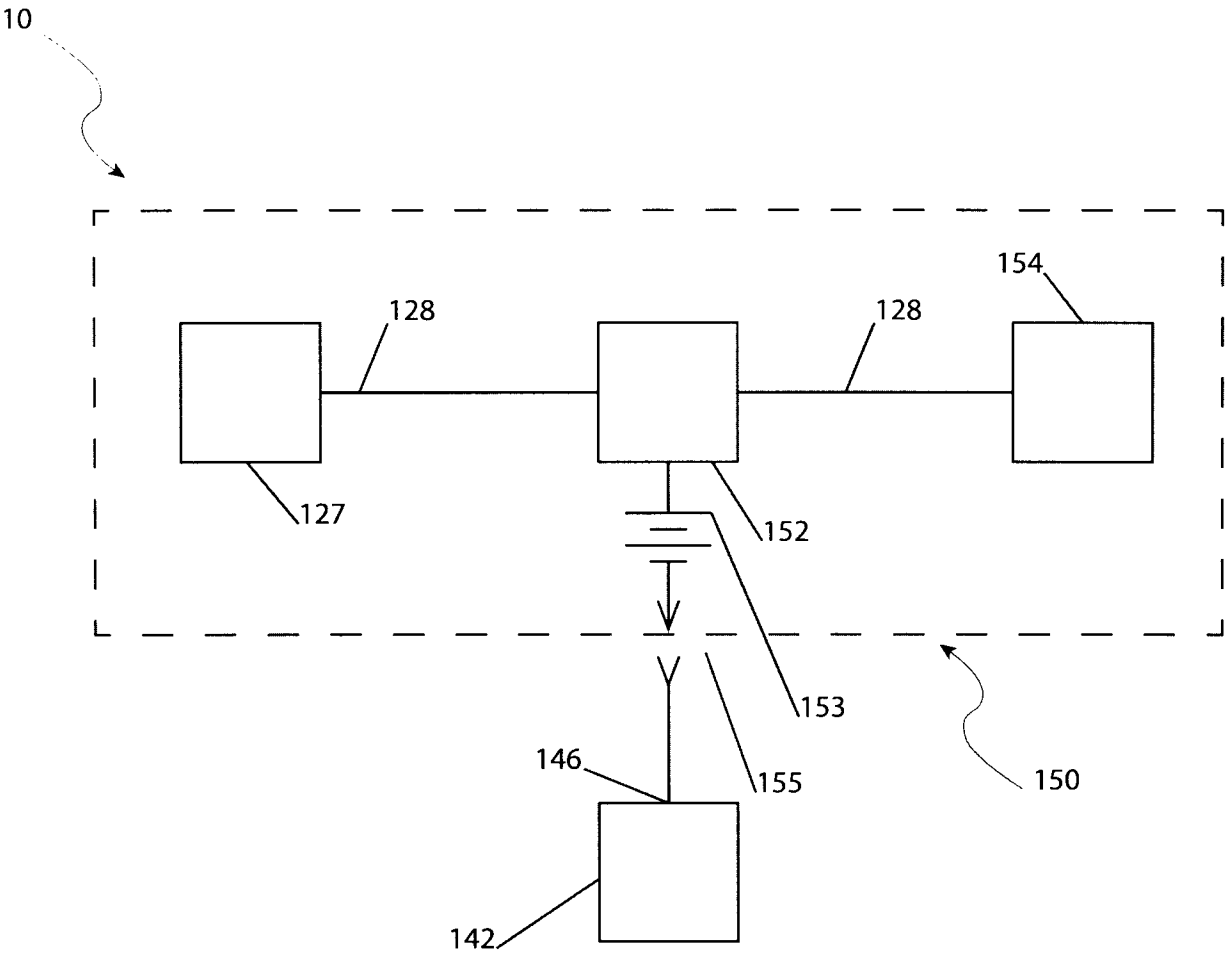
FIG. 12 is a block diagram of an electrical system 150 of the outdoor blanket 10.

The flexible solar panel 127 (see FIG. 2) is peripherally attached to the bonnet 126 in an appropriate manner and is configured to supply electrical power to the remainder of an electrical system 150 in the outdoor blanket 10 by conductors 128 (also see FIG. 12). The conductors 128 are preferably routed along the mast tube 123 which are located nearest to the midline of the outdoor blanket 10 and down the flap 82 of the backrest 80 to enter a speaker pocket 140. The speaker pocket 140 is discussed subsequently. The conductors 128 are provided with a number of connector plugs as appropriate for convenient assembly and disassembly of the outdoor blanket 10. The detachable shade 120 may be disassembled by removal of the bonnet 126 and the attached solar panel 127 from the carrier arms 125 prior to insertion of the framework (mast tubes 123, carrier arms 125, etc.) into the carrying case 180 for transportation or for storage (see FIG. 13 and discussed in more detail subsequently).

Figure 8:
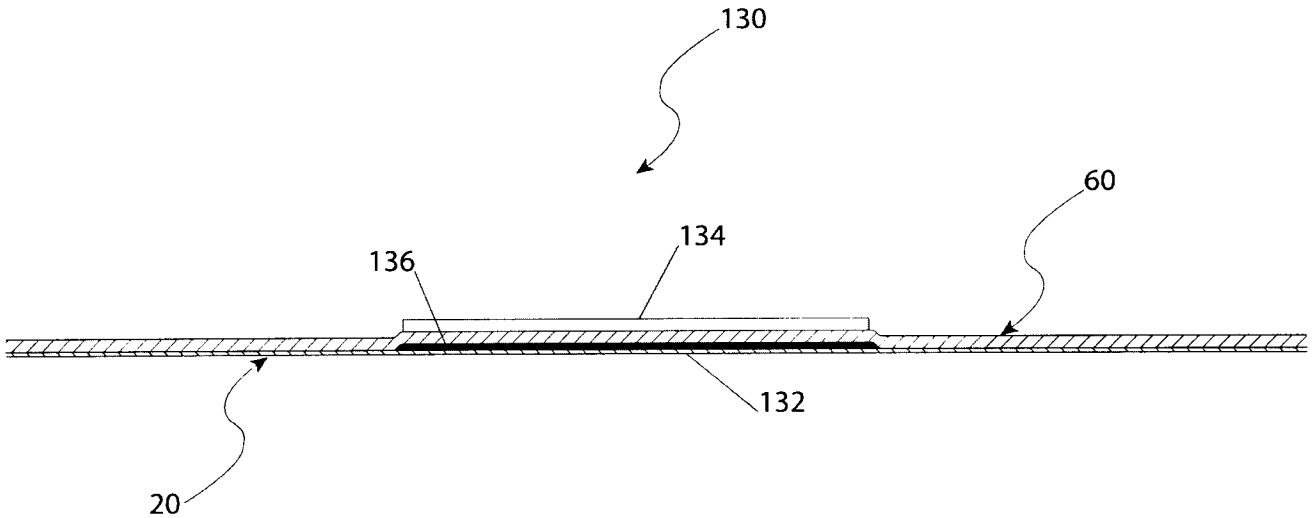
FIG. 8 is a section view along lines A-A of FIG. 1.

Refer now to FIG. 8 for a section view taken along lines A-A of FIG. 1. FIG. 8 shows a cut through a main pocket 130.

The main pocket 130 is approximately five inches (5 in.) wide and is located between a pair of backrests 80. The main pocket 130 is configured as an envelope 132 and is preferably made of cotton or of a cotton/polyester blend that is sewn to the cover layer 60 with a hemmed opening 134. The main pocket 130 is thus formed between the cover layer 60 and the bottom layer 20. The envelope 132 is either made of a single piece of material that is doubled over and sewn along lateral edges or of two (2) or more pieces of material that are sewn along some their perimeters. The main pocket 130 is helpfully supplied with an incidental cotton wiper 136 for cleaning a user's eyewear.

Figure 9:
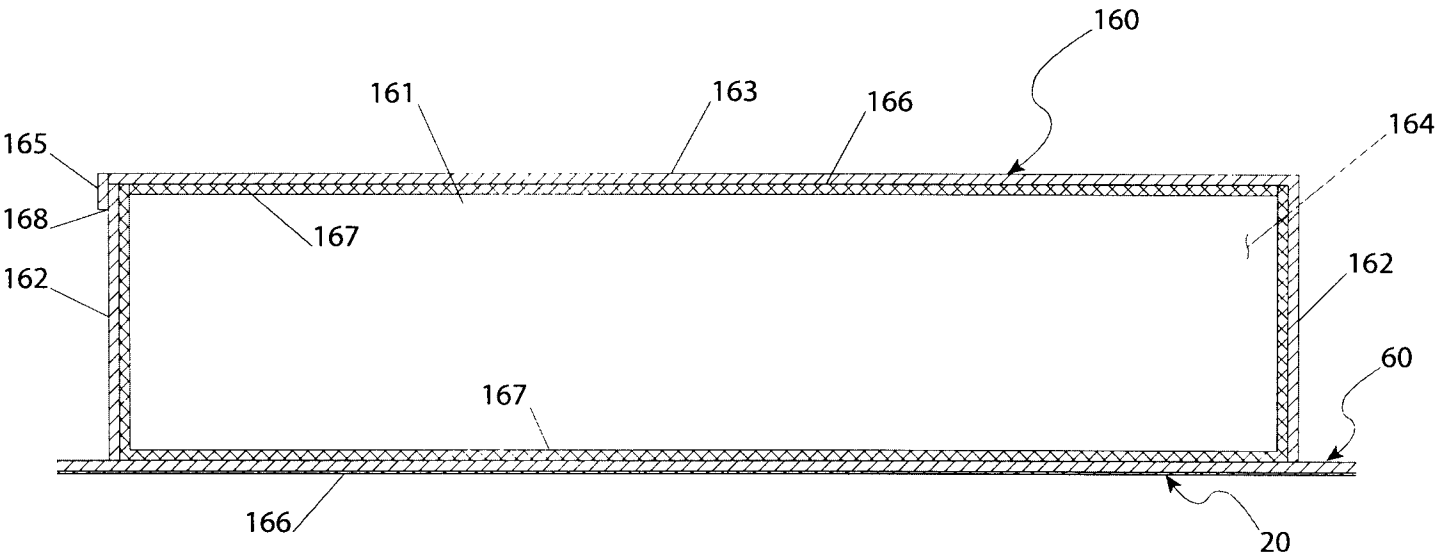
FIG. 9 a section view along lines B-B of FIG. 1.

Refer now to FIG. 9 for a section view taken along lines B-B of FIG. 1. FIG. 9 shows a cut through a cooler 160 which is preferably located near a lateral edge 22. The cooler 160 includes a cooler pocket 161, a layer of insulation 166, and a moisture barrier 167. The cooler pocket 161 is configured to be made by a strip of material which is appreciably the same as the cover layer 60 and which is attached to the cover layer 60 in a rectangular formation to form walls 162. The walls 162 are hemmed prior to attachment to the cover layer 60. A rectangular piece of hemmed material forms a lid 163 which is made from the same material as the cover layer 60 and is affixed to an upper side of the wall 162 around about half of the periphery of the lid 163. The lid 163 is provided with an additional strip of hemmed material that is attached to the remainder of the periphery of the lid 163 to form an overlap 165 of material which will project downward along the exterior face of the walls 162.

The interior face of the overlap 165 as well as the exterior face of the wall 162 shielded by the overlap 165 are provided with a closure 168 preferably made from complementary components of a hook-and-loop fastener such as VELCRO®. Thus the cooler pocket 161 has walls 162 and a lid 163 that can be opened by disengaging the closure 168 and folding that portion over the remainder of the lid 163 to access an interior 164 while maintaining the flexibility inherently necessary for rolling the outdoor blanket 10 for storage.

The interior 164 is covered with a layer of insulation 166 consisting of high-efficiency insulating material to provide an area which can be thermally depressed for the temporary storage of foodstuffs and/or beverages. A moisture barrier 167 is disposed on the inner face of the insulation 166 to prevent condensation on the insulation 166, which would adversely affect efficiency.

Figure 10:
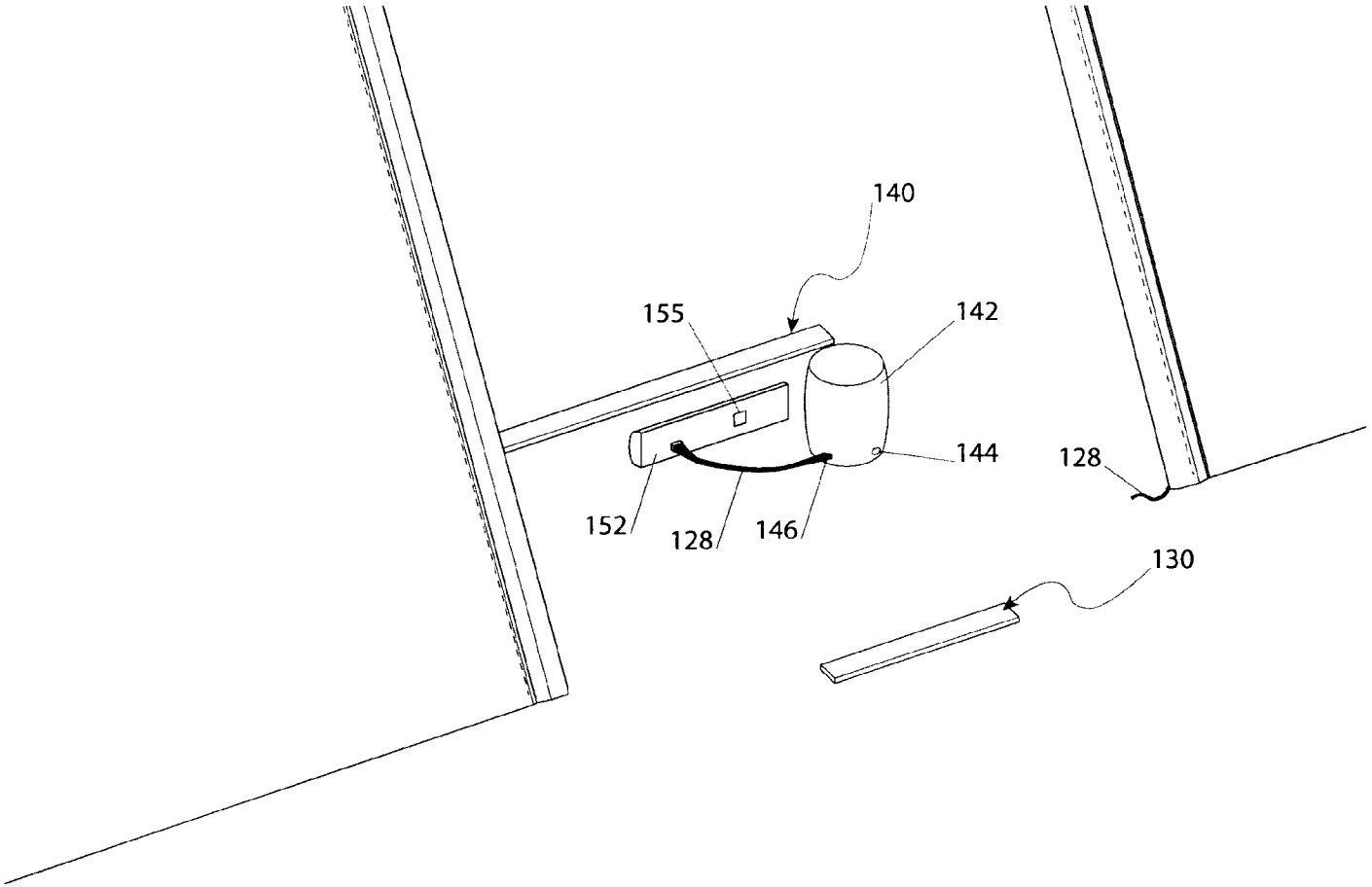
FIG. 10 is an isolated view of a speaker pocket 140 of the outdoor blanket 10.

Refer now to FIG. 10 for an isolated view of a speaker pocket 140 and a speaker 142 that is located exterior to the speaker pocket 140. The speaker pocket 140 is similar in materials and construction to the main pocket 130 and is used as a storage area for the speaker 142 and certain components of the electrical system 150. The speaker 142 is a commercially available can-type, miniature device designed for the amplification of sound from sources such as hand-held electronic devices. The speaker 142 is provided with an input jack 144 configured to comply with a headphone jack and a separate charging port 146 for recharging an internal battery 153 (see FIG. 12), either through the charging circuit 152 or through a separate independent source via a battery input connector 155. Electrical wiring 128 makes the required connections.

Refer now to FIG. 12 for a block diagram of the electrical system 150 of the outdoor blanket 10. The electrical system 150 includes the solar panel 127, the charging circuit 152, and conductors 128 or other interconnecting wiring. The solar panel 127 attached to the bonnet 126 of the shade 120 and converts sunlight into electrical energy which is transmitted to a charging circuit 152 and from there to a low-voltage power jack 154 via a conductor 128. The charging circuit 152 is equipped with a controller for over-current prevention, back-flow prevention, and other control operations to create an appropriate voltage for recharging the battery contained within the speaker 142 or any similar such battery.

Refer now to FIG. 13 for an isometric view of a carrying case 180 for carrying and storing the outdoor blanket 10. The carrying case 180 is preferably composed of a heavy cotton material. The carrying case 180 is configured to be an elongated bag 182 closed at one (1) end and with a divider 184 that maintains the separation between the collapsed support frames 90 and the remainder of the outdoor blanket 10. The open end of the bag 182 is provided with a hem 186 that is sufficient to accommodate the insertion of a retainer 188 that closes the bag 182. The retainer 188 is preferably a narrow tube of the same constituent material of the bag 182 and is generally formed to hold a tie string which can be cinched and secured to close the carrying case 180 after the outdoor blanket 10 is inserted.

The method of preparing the outdoor blanket 10 for insertion into the carrying case 180 can be performing by: removing the umbrella (if any) from the stake aperture 176 if an umbrella had been deployed; removing any other miscellaneous items from the outdoor blanket 10 to clear the top face 66; disconnecting the solar panels 127 from the electrical system 150; disconnecting any other electrical devices such as the speaker 142 from the electrical system 150; removing the shades 120 from the support frames 90; removing the bonnets 126 from the carrier arms 125; removing the support frames 90 from the backrests 80; collapsing the support frames 90 as illustrated in FIG. 7; inserting the collapsed support frames 90 into the carrying case 180; inserting the collapsed mast tubes 123 and carrier arms 125 into the carrying case 180; placing the bonnets 126 with the attached panels 127 over the flaps 82 of the backrests 80; deflating and collapsing the pneumatic chamber 30; removing the items from the cooler 160; placing the speaker 142 into the speaker pocket 140; disconnecting any stabilization mechanisms from the grommets 38; turning approximately one third (⅓) of the foot 16 of the outdoor blanket 10 over upon the central portion of the outdoor blanket 10 to form a fold 76; turning the folded two thirds (⅔) of the outdoor blanket 10 over upon the head 14 of the outdoor blanket 10 to form another fold 76; rolling the outdoor blanket 10 tightly from one (1) edge 22 to form a roll 74; inserting the roll 74 into the carrying case 180; and securing the carrying case 180 with the retainer 188.

Refer now to FIGS. 14 and 15 for isolated views of an alternate support frame 200 for the backrest 80. The alternate support frame 200 utilizes a fixed third diagonal 214 and a fixed fourth diagonal 216 which are connected together by a pin fastener 218 that enables relative rotation. The alternate support frame 200 also includes a third vertical 202 and a fourth vertical 210. The hemmed channels 86 of the flap 82 are capable of accommodating the insertion of the third vertical 202 and the fourth vertical 210. The third vertical 202 includes a top tube 204, a fixed tube 208, and an adjustment tube 206. The fixed tube 208 fits inside of and is permanently attached to the top tube 204. The fixed tube 208 also fits inside the adjustment tube 206 in a sliding relationship that governs the overall length of the third vertical 202 (reference the next paragraph). The members of the alternate support frame 200 are preferably composed of round aluminum tubing.

Still referring to FIGS. 14 and 15, disposed inside the lower end of the fixed tube 208 is the spring-biased button 94. The button 94 projects through one of the adjustment apertures 212 in the lower end of the adjustment tube 206. The button 94 projects a sufficient distance that it engages one (1) of the adjustment apertures 212. The shortest length of the third vertical 202 occurs when the button 94 is engaged in the bottom-most adjustment aperture 112 and the lower end of the top tube 204 abuts the upper end of the adjustment tube 206. In this arrangement, the backrest 80 is maintained at the steepest angle of repose and the user is reclining at the most upright position. The longest length of the third vertical 202 occurs when the button 94 is engaged in the upper-most adjustment aperture 212 of the adjustment tube 206 and the backrest 80 is secured in the lowest angle of repose.

The fourth vertical 210 is fabricated just as the third vertical 202 with a top tube 204, a fixed tube 208, and an adjustment tube 206. The third vertical 202 is attached to the fixed third diagonal 214 through a flex joint 102 as previously described. The fourth vertical 210 is attached to a fixed fourth diagonal 216 through a similar flex joint 102. The lower ends of the third diagonal 202 and the fourth diagonal 210 are stabilized in tube receivers 112 that are located on the top face 66 of the cover layer 60. The alternate support frame 200 may be collapsed as shown in FIG. 15 for insertion into the carrying case 180. The detachable shade 120 may be connected to the alternate support frame 200 by the same method as previously described for the support frame 90 and depicted in FIG. 14.

The preferred embodiment of the present invention can be utilized in a simple and straightforward manner with little or no training. The method of installing and utilizing the device 10 may be achieved by performing a series of steps as described below.

After initial purchase or acquisition of the outdoor blanket 10, the outdoor blanket 10 may be used by; removing the roll 74 from the carrying case 180; removing the support frame(s) 90 from the carrying case 180; placing the roll 74 on the ground or other selected support surface; unrolling and unfolding the outdoor blanket 10 with the lower face 26 of the bottom layer 20 in contact with the ground; stabilizing the outdoor blanket 10 by securing the grommets 38 to the support surface using an appropriate technique; inflating the pneumatic chamber 30 with air; inserting the support frame(s) 90 into the backrest(s) 80 with the first vertical 104 and the second vertical 106 adjusted to the desired recumbent angle; attaching the shade(s) 120 to the support frame(s) 90; connecting the solar panel(s) 127 to the electrical system 150; inserting the desired items into the cooler 160; inserting the desired items into the main pocket 130; connecting the appropriate electrical device to the speaker 142 by inserting the proper connector into the input jack 144; utilizing the sound system when desired; utilizing the wiper 136 when desired; connecting an appropriately selected electrical device to the charging circuit 152 of the electrical system 150; placing a beverage container into a selected cup holder 170; erecting an umbrella by placing a pointed end of a support pole through the stake aperture 176 and driving it into the subjacent support surface; and reclining on the outdoor blanket 10.

The method of using the alternate embodiment of the outdoor blanket 10 may be achieved by performing the same steps as previously described with the exception of adjusting the lengths of the third vertical 202 and the fourth vertical 210 by depressing the respective buttons 94 and sliding the fixed tubes 208 relative to the top tubes 204 to effectuate the desired recumbent angle, and inserting the alternate support frame 200 into the backrest 80 and the tube receivers 112.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A blanket, comprising:

a water-resistant bottom layer;

an inflatable pneumatic chamber affixed to said bottom layer, said pneumatic chamber having a nozzle for receiving air;

a cover layer affixed to said bottom layer;

a backrest having a shade assembly, said backrest affixed to said cover layer;

a collapsible support frame;

a solar panel affixed to said shade assembly;

an insulated cooler;

a first pocket; and, an electrical system in electrical communication with said solar panel, said electrical system including a charging circuit for charging an internal battery;

wherein said collapsible support frame supports said backrest, said shade assembly, and said solar panel; and, wherein said cover layer includes receivers for receiving bottom ends of said collapsible support frame.

2. The blanket of claim 1, wherein said pneumatic chamber has interconnected air containment cells.

3. The blanket of claim 1, wherein said nozzle is a low volume nozzle on a surface of said pneumatic chamber, said low volume nozzle having a retraction fold enabling said low volume nozzle to be folded into itself.

4. The blanket of claim 1, wherein said nozzle is a high volume nozzle located on a surface of said pneumatic chamber.

5. The blanket of claim 1, further including a grommet adjacent a corner of said cover layer.

6. The blanket of claim 1, further comprising a cup holder extending from said cover layer.

7. The blanket of claim 1, further comprising an aperture passing through said bottom layer and through said cover layer for receiving a pole.

8. The blanket of claim 1, wherein said collapsible support frame includes:

a first vertical member having a first vertical upper end;

a first diagonal frame member having a first diagonal lower end, a first diagonal upper end and a first spring-biased member disposed between said first diagonal lower end and said first diagonal upper end;

a first flex joint attaching said first vertical upper end to said first diagonal upper end;

a second vertical member having a second vertical upper end;

a second diagonal frame member having a second diagonal lower end, a second diagonal upper end and a second spring-biased member disposed between second diagonal lower end and said second diagonal upper end;

a second spring-biased attachment for adjusting the relative position of said second diagonal frame member to said cover layer; and, a second flex joint attaching said second vertical upper end to said second diagonal upper end.

9. The blanket of claim 1, wherein said collapsible frame includes:

a first diagonal;

a second diagonal;

a fastener connecting said first diagonal to said second diagonal;

a first vertical having a first top tube, a first adjustment tube having a first bottom aperture, and a first fixed tube extending from said first top tube and into said first adjustment tube; said first adjustment tube including a first button that mates with said first bottom aperture;

a second vertical having a second top tube, a second adjustment tube having a second bottom aperture, and a second fixed tube extending from said second top tube and into said second adjustment tube; said second adjustment tube including a second button that mates with said second bottom aperture;

a first flex joint connecting said first diagonal to said first top tube; and, a second flex joint connecting said second diagonal to said second top tube.

10. The blanket of claim 1, wherein said shade assembly comprises:

a pair of mast tubes;

a pair of carrier arms;

a pair of hinge brackets, each connecting a first end of an individual mast tube to a first end of an individual carrier arm;

a bonnet spanning between said carrier arms; and, at least one shade attachment affixed to said mast tube for mounting said shade assembly to said collapsible frame.

11. The blanket of claim 1, wherein said cooler includes:

an interior cooler pocket affixed to said cover layer disposed and disposed between said cover layer and said bottom layer;

a lid affixed to said cover layer and disposed externally therefrom, said lid having a closure fastener;

an insulation layer affixed inside said cooler pocket; and, a moisture barrier affixed inside said insulation layer.

12. The blanket of claim 1, wherein said electrical system includes:

a conductor in electrical communication with said charging circuit and routed through said collapsible frame; and, a low voltage jack in electrical communication with said conductor;

wherein said charging circuit is in electrical communication with said solar panel.

13. The blanket of claim 12, further comprising a speaker removable from a second pocket and having an input connection configured to be in electrical communication with an external entertainment device, wherein said speaker is in electrical communication with said conductor.

14. A combination, comprising:

a carrying case having an open end, a closed end, a divider located within said case, and a retainer for selectively opening and closing said open end;

a blanket comprising:

a water-resistant bottom layer;

an inflatable pneumatic chamber affixed to said bottom layer, said pneumatic chamber having a nozzle for receiving air;

a cover layer affixed to said bottom layer; a shade assembly; a collapsible frame;

a backrest affixed to said cover layer, said backrest configured to retain said collapsible frame and said shade assembly;

a solar panel affixed to said shade assembly; an insulated cooler located within said blanket; at least one pocket; and, an electrical system in electrical communication with said solar panel; wherein said collapsible frame supports said backrest, said shade assembly, and said solar panel;

wherein said blanket fits within said carrying case.

15. The combination of claim 14, wherein said pneumatic chamber has interconnected air containment cells.

16. The combination of claim 14, wherein said nozzle is a low volume nozzle located on said pneumatic chamber and which is configured to have a retraction fold enabling said low volume nozzle to be folded into said pneumatic chamber.

17. The combination of claim 14, wherein said nozzle is a high volume nozzle located on said pneumatic chamber.

18. The combination of claim 14, further including a grommet located adjacent a corner of said cover layer.

19. The combination of claim 14, further comprising at least one cup holder attached to cover layer.

20. The combination of claim 14, further comprising an aperture and an overlapping hemmed feature to conceal said aperture.

21. The combination of claim 14, wherein said collapsible frame includes:

a first vertical member having a first vertical upper end;

a first diagonal frame member having a first diagonal lower end, a first diagonal upper end and a first spring-biased member disposed between said first diagonal lower end and said first diagonal upper end;

a first flex joint attaching said first vertical upper end to said first diagonal upper end;

a second vertical member having a second vertical upper end;

a second diagonal frame member having a second diagonal lower end, a second diagonal upper end and a second spring-biased member disposed between second diagonal lower end and said second diagonal upper end;

a second spring-biased attachment for adjusting the relative position of said second diagonal frame member to said cover layer; and, a second flex joint attaching said second vertical upper end to said second diagonal upper end.

22. The combination of claim 14, wherein said collapsible frame further comprises:

a first diagonal;

a second diagonal;

a fastener connecting said first diagonal to said second diagonal;

a first vertical having a first top tube, a first adjustment tube having a first bottom aperture, and a first fixed tube extending from said first top tube and into said first adjustment tube; said first adjustment tube including a first button that mates with said first bottom aperture;

a second vertical having a second top tube, a second adjustment tube having a second bottom aperture, and a second fixed tube extending from said second top tube and into said second adjustment tube; said second adjustment tube including a second button that mates with said second bottom aperture;

a first flex joint connecting said first diagonal to said first top tube; and, a second flex joint connecting said second diagonal to said second top tube.

23. The combination of claim 14, wherein said shade assembly includes:

a pair of mast tubes;

a pair of carrier arms;

a pair of hinge brackets, each connecting to a first end of an individual mast tube to a first end of an individual carrier arm;

a bonnet spanning between said carrier arms; and, at least one shade attachment affixed to said mast tube for mounting said shade assembly to said collapsible frame.

24. The combination of claim 14, wherein said cooler includes:

an internal cooler pocket affixed to said cover layer;

a lid affixed to said cover layer and disposed externally therefrom, said lid having a closure fastener;

an insulation layer affixed inside said cooler pocket;

a moisture barrier affixed within said insulation layer.

25. The combination of claim 14, wherein said electrical system further comprises:

a conductor in electrical communication with said charging circuit and routed through said collapsible frame; and, a low voltage jack in electrical communication with said conductor;

wherein said charging circuit is in electrical communication with said solar panel.

26. The combination of claim 25, further comprising a speaker residing within a speaker pocket and having an input connection configured to be in electrical communication with an external entertainment device;

wherein said speaker is in electrical communication with said conductor.

* * * * *